US012371954B1

(12) United States Patent
Mutairi et al.

(10) Patent No.: US 12,371,954 B1
(45) Date of Patent: Jul. 29, 2025

(54) SLEEVE ASSEMBLIES FOR COILED TUBING

(71) Applicant: SAUDI ARABIAN OIL COMPANY, Dhahran (SA)

(72) Inventors: Mansour Mutairi, Khurais (SA); Khaled Alsunnary, Khurais (SA); Metab Enizi, Khurais (SA); Rayan Albwardi, Khurais (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 9 days.

(21) Appl. No.: 18/425,479

(22) Filed: Jan. 29, 2024

(51) Int. Cl.
*E21B 19/22* (2006.01)

(52) U.S. Cl.
CPC ..... *E21B 19/22* (2013.01)

(58) Field of Classification Search
CPC ..... E21B 19/22; F16L 55/168–18
See application file for complete search history.

(56) References Cited

U.S. PATENT DOCUMENTS

| | | | | |
|---|---|---|---|---|
| 5,722,463 | A * | 3/1998 | Smyth | F16L 55/17 138/158 |
| 6,997,260 | B1 * | 2/2006 | Trader | F16L 55/1683 138/99 |
| 9,580,281 | B2 | 2/2017 | Foley et al. | |
| 2016/0334045 | A1 * | 11/2016 | Smyth | F16L 55/172 |
| 2020/0011169 | A1 * | 1/2020 | Haghshenas | G01B 7/10 |
| 2024/0117908 | A1 * | 4/2024 | King | E21B 17/041 |

* cited by examiner

*Primary Examiner* — David Carroll
(74) *Attorney, Agent, or Firm* — Vorys, Sater, Seymour and Pease LLP

(57) ABSTRACT

A coiled tubing system includes a coiled tubing injector assembly, a reel arranged adjacent the injector assembly, coiled tubing extending between the reel and the injector assembly and partially wound onto the reel, the coiled tubing having damaged section, and a sleeve assembly removably attachable to the coiled tubing at the damaged section. The sleeve assembly includes a sleeve having opposing first and second ends and sized to be received about an outer circumference of the coiled tubing, the sleeve exhibiting a length sufficient to extend over and cover the damaged section, and first and second clamps removably attachable to the sleeve at the opposing first and second ends, respectively, and thereby securing the sleeve to the outer circumference of the coiled tubing.

16 Claims, 4 Drawing Sheets

SLEEVE ASSEMBLIES FOR COILED TUBING

FIELD OF THE DISCLOSURE

The present disclosure relates generally to coiled tubing and, more particularly, to sleeve assemblies used to temporarily secure a damaged section of coiled tubing.

BACKGROUND OF THE DISCLOSURE

In the oil and gas industry, coiled tubing (alternately referred to as "coil tubing") is often used for performing various downhole operations, such as washing out sand bridges, circulating treating fluids, running logging or intervention tools, setting downhole tools, milling debris within the wellbore, cleaning internal walls of well pipes, fishing out lost tools in the wellbore, conveying producing fluids or lift gases downhole, and a number of other remedial or production-related operations. More recently, coiled tubing has also been used in drilling operations. To undertake drilling operations, various types of downhole tools and bottom hole assemblies (BHAs) can be attached to the downhole (distal) end of coiled tubing, and the coiled tubing is then conveyed downhole in a controlled manner from the well surface using a coiled tubing injector system.

Among other components, coiled tubing injector systems include a surface-mounted injector assembly or "injector head" operatively coupled to a sliding seal system referred to as a "stripper." After the coiled tubing is conveyed through the stripper, the injector head literally forces or "injects" the coiled tubing downward and into the well at a force sufficient to overcome the well pressure and until the weight of the tubing exceeds the force produced by the pressure acting against the cross-sectional area of the tubing. Thereafter, the weight of the tubing will be supported by the injector head. The process is reversed as the coiled tubing is removed from the well. Advances in the design of coiled tubing have resulted in large tubings having increased wall thickness and sufficient tensile strength to support up to 20,000 feet hanging in a wellbore.

While running coiled tubing downhole or pulling coiled tubing out of a wellbore, occasionally a section of the coiled tubing can become damaged. In such circumstances, the coiled tubing must be pulled out of the wellbore and repaired or risk a sudden failure of the coiled tubing, which can have serious operational and health, safety, and environment (HSE) ramifications.

What is needed is a system and method of manually securing and temporarily repairing damaged (or defected) sections of coiled tubing on surface.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the disclosure, a coiled tubing system includes a coiled tubing injector assembly, a reel arranged adjacent the injector assembly, coiled tubing extending between the reel and the injector assembly and partially wound onto the reel, the coiled tubing having damaged section, and a sleeve assembly removably attachable to the coiled tubing at the damaged section. The sleeve assembly includes a sleeve having opposing first and second ends and sized to be received about an outer circumference of the coiled tubing, the sleeve exhibiting a length sufficient to extend over and cover the damaged section, and first and second clamps removably attachable to the sleeve at the opposing first and second ends, respectively, and thereby securing the sleeve to the outer circumference of the coiled tubing.

According to another embodiment consistent with the disclosure, a method of repairing coiled tubing include the steps of locating a damaged section of the coiled tubing, mounting a sleeve to the coiled tubing at the damaged section, the sleeve having opposing first and second ends and exhibiting a length sufficient to extend over and cover the damaged section, and securing first and second clamps to the sleeve at the first and second ends, respectively, and thereby securing the sleeve to an outer circumference of the coiled tubing.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
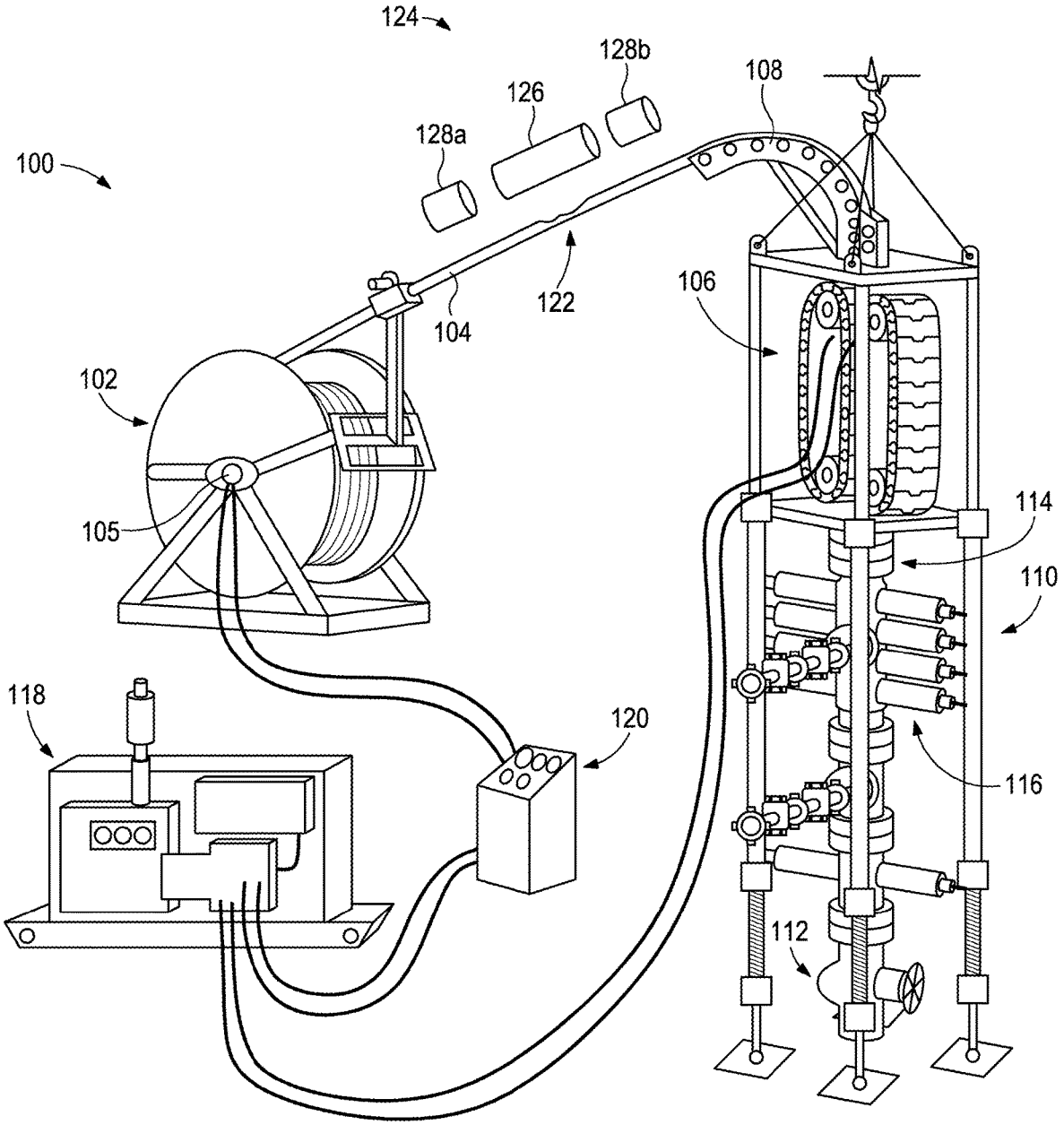
FIG. 1 is a schematic diagram of an example coiled tubing system that may employ the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to coiled tubing systems and temporarily repairing a damaged section of the coiled tubing. One example coiled tubing system described herein includes a coiled tubing injector assembly, a reel arranged adjacent the injector assembly, coiled tubing extending between the reel and the injector assembly and partially wound onto the reel, the coiled tubing having damaged section, and a sleeve assembly removably attachable to the coiled tubing at the damaged section. The sleeve assembly includes a sleeve having opposing first and second ends and sized to be received about an outer circumference of the coiled tubing. The sleeve exhibits a length sufficient to extend over and cover the damaged section. First and second clamps may be removably attachable to the sleeve at the opposing first and second ends, respectively, and thereby securing the sleeve to the outer circumference of the coiled tubing.

FIG. 1 is a schematic diagram of an example coiled tubing system 100 that may employ the principles of the present disclosure. The coiled tubing system 100 (hereafter "the system 100") may be arranged at a well site where a wellbore is drilled into the ground. As illustrated, the system 100 includes a spool or "reel" 102, which serves as a storage apparatus for coiled tubing 104. The coiled tubing 104 comprises a continuous length of flexible pipe capable of being wound onto and unwound from the reel 102. In some applications, the reel 102 may be mounted to a transport vehicle, such as a truck, but could alternatively be mounted to a production rig or may otherwise be skid-mounted. Rotation of the reel 102 may be controlled by a hydraulic motor 105 mounted as a direct drive on the reel 102 or operated by a chain-and-sprocket drive assembly (not shown).

The coiled tubing 104 is guided from the reel 102 to an injector assembly 106 via a tubing guide arch 108, alternately referred to as a "gooseneck." The tubing guide arch 108 supports the coiled tubing 104 through a bending radius, for example 90°, and guides the coiled tubing 104 into the injector assembly 106. The injector assembly 106, alternately referred to as an "injector head," is designed to grip the outer circumference of the coiled tubing 104 and provide the force required to convey the coiled tubing 104 downward and into a wellbore and subsequently retrieve the coiled tubing 104. The injector assembly 106 is designed to support the full weight of the coiled tubing 104, and allows an operator to control the rate of lowering the coiled tubing 104 into the well.

The system 100 may further include a well control stack 110 operatively coupled to the injector assembly 106 and interposing the injector assembly 106 and a wellhead 112, which constitutes the surface termination of a wellbore drilled into the underlying earth surface. The well control stack 110 can include, for example, a stripper assembly 114 and a blowout preventer or "BOP" 116. The stripper assembly 114 interposes the injector assembly 106 and the BOP 116 and provides the necessary pressure control and lubrication for the coiled tubing 104 as the coiled tubing 104 is conveyed downhole or retrieved.

The BOP 116 may comprise a plurality of hydraulically-operated rams. For example, the BOP 116 can include one or more blind rams, tubing shear rams, slip rams, and pipe rams. The blind rams may be used to seal off the wellbore at the surface if well control is lost. The tubing shear rams may be used to mechanically break (sever) the coiled tubing 104 in the event the coiled tubing 104 becomes stuck within the well control stack 110 or whenever it may be necessary to cut the coiled tubing 104 and remove the surface equipment from the well. The slip rams may include bidirectional teeth, which, when activated, secure against the coiled tubing 104 and support the weight of the coiled tubing 104 and any tools or assembly coupled thereto. The pipe rams may be equipped with elastomer seals and may be used to isolate the wellbore annulus pressure below the BOP 116.

The system 100 may further include a power source 118 (alternately referred to as a "power pack") used to power operation of the injector assembly 106 and the reel 102. In some applications, the power source 118 may comprise a hydraulic-pressure pump system including one or more multistage hydraulic pumps powered by one or more diesel engines. Alternatively, the power source 118 may comprise an electric generator system. The power source 118 may be designed to convey hydraulic fluid to operate various components of the system 100, such as the reel 102 and the injector assembly 106. In particular, among other operations, hydraulic fluid may be conveyed to operate the hydraulic motor 105 of the reel 102 and various hydraulic motors of the injector assembly 106, and thereby selectively control movement of the coiled tubing 104.

In some applications, the system 100 may also include a control console 120 in communication with the power source 118. The control console 120 can include various controls and gauges required to operate and monitor all of the components during operation of the system 100. An operator may be able to control operation of all facets of the system 100 from the control console 120. The hydraulic motors 105 of the reel 102 and the injector assembly 106 may be activated (operated) via the control console 120, which may be configured to manipulate one or more valves that determine the direction of motion for the coiled tubing 104 and operating speed and braking.

While rare, and for a variety of reasons, the coiled tubing 104 can sometimes become damaged (e.g., deformed, punctured, defected, etc.) during use. For example, the coiled tubing 104 can become damaged due to differential forces between inner and outer portions of the coiled tubing 104. This can happen through blunt physical force applied against the outer circumference of the coiled tubing 104, such as in the event that a hydraulically-operated ram of the BOP 116 inadvertently closes on the coiled tubing 104. This could also happen if a portion of the wellbore collapses on the coiled tubing 104. The coiled tubing 104 may also become damaged (e.g., deformed, punctured, etc.) if a well operator underestimates wellbore pressures and a resulting differential pressure causes the wall of the coiled tubing 104 to collapse. Moreover, the coiled tubing 104 could become damaged through fatigue resulting, for example, manufacture error in the design or creation.

In FIG. 1, the coiled tubing 104 is shown including a damaged portion or section 122 located between the reel 102 and the tubing guide arch 108. In the illustrated embodiment, the damaged section 122 comprises a portion of the coiled tubing 104 that is deformed or otherwise partially or fully collapsed into the interior of the coiled tubing 104. In some applications, the damaged section 122 may further include a cut (puncture, perforation, etc.) in the wall of the coiled tubing 104. The damaged section 122 compromises the integrity of the coiled tubing 104, thereby risking sudden failure of the coiled tubing 104 and a potential leak path for fluids circulating through the coiled tubing 104. In such circumstances, the coiled tubing 104 must be pulled out of the wellbore and repaired, and otherwise the damaged section 122 must be wound back onto the reel 102 without entirely severing the coiled tubing 104.

According to embodiments of the present disclosure, a sleeve assembly 124 may be used to temporarily secure the damaged section 122 of the coiled tubing 104. In some applications, the sleeve assembly 124 may remain in place until the coiled tubing 104 is securely pulled out of the wellbore and wound onto the reel 102. As illustrated, the sleeve assembly 124 may include a sleeve 126 sized to be received about the outer circumference of the coiled tubing 104 and having a length sufficient to extend over (cover, occlude, etc.) the damaged section 122. The sleeve assembly 124 may further include opposing first and second clamps 128*a* and 128*b* used to secure the sleeve 126 to the outer circumference of the coiled tubing 104.

As described herein, the sleeve assembly 124 may be manually installed on the coiled tubing 104 by a well operator and/or one or more rig workers (collectively referred to herein as "well operator"). In at least one embodiment, for example, the well operator may operate the system 100 to locate (position) the damaged section 120 between the reel 102 and the tubing guide arch 108, but could otherwise locate the damaged section 120 at other locations accessible by the well operator, without departing from the scope of the disclosure. The damaged section 120 may be accessed by the well operator using a hydraulic lift (e.g., man-basket, etc.) or the like. Once positioned adjacent the damaged section 120, the well operator may then mount the sleeve 126 on the coiled tubing 104 covering the damaged section 120, and subsequently secure the sleeve 126 to the coiled tubing 104 by manually attaching (e.g., threading) the clamps 128*a,b* to the opposing ends of the sleeve 126.

Figure 2:
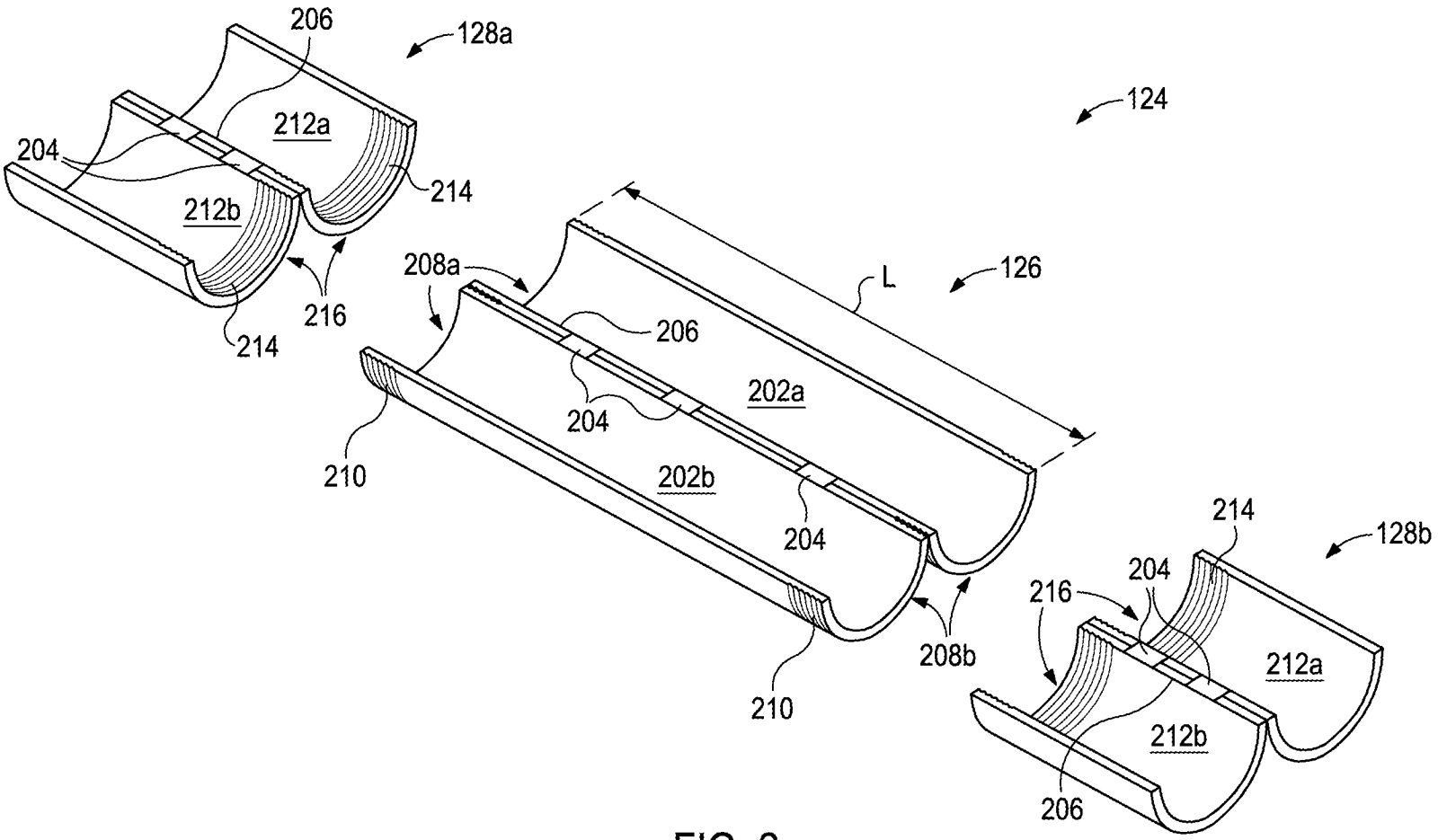
FIG. 2 is an exploded, isometric view of the sleeve assembly of FIG. 1, according to one or more embodiments.
Figure 3A:
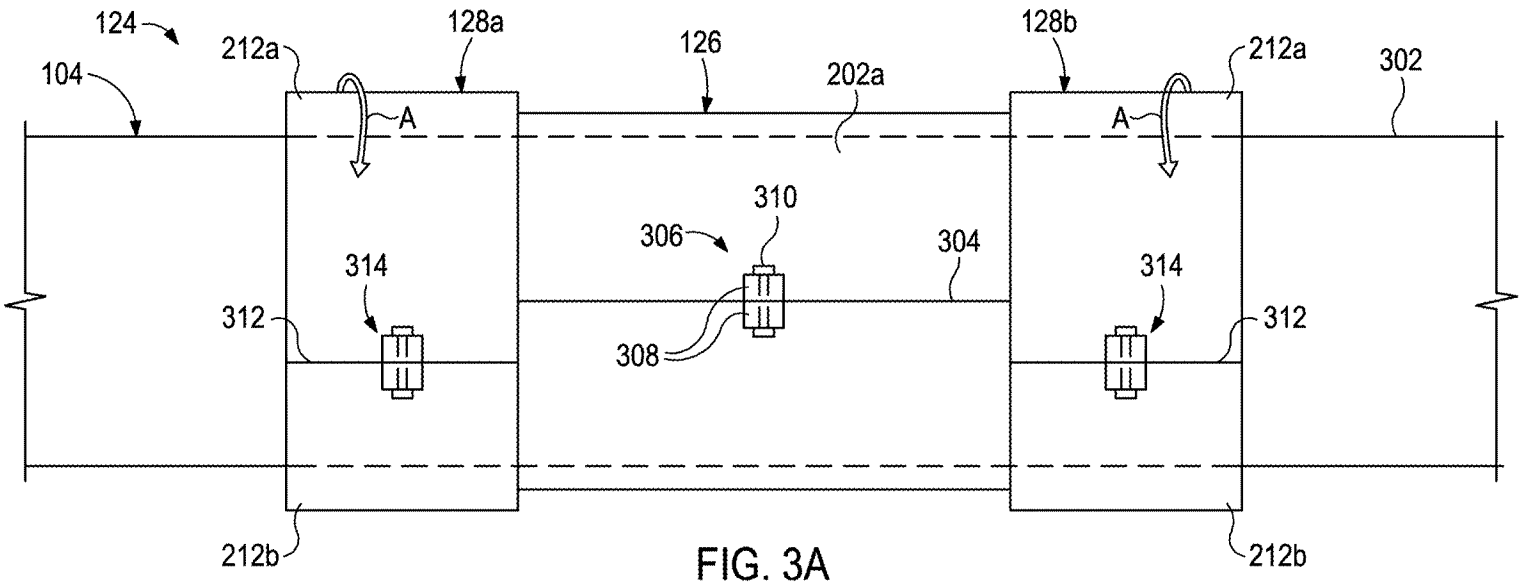
FIGS. 3A and 3B are side and cross-sectional side views, respectively, of the sleeve assembly of FIGS. 1 and 2 installed on a section of the coiled tubing, according to one or more embodiments.
Figure 3B:
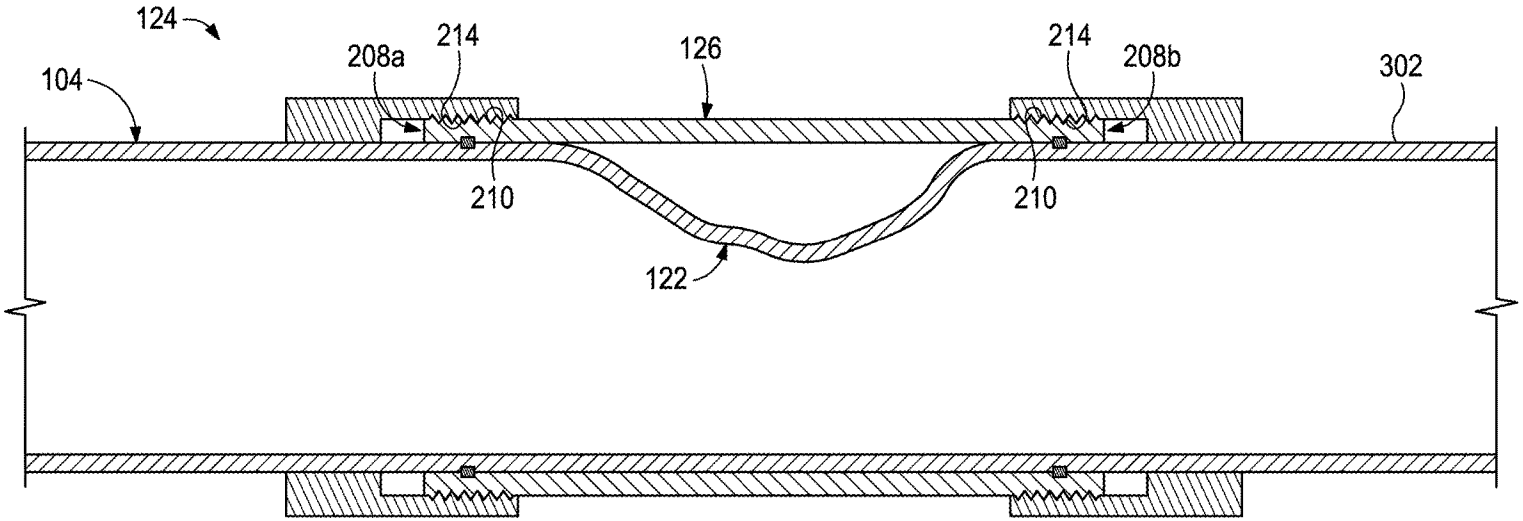

FIG. 2 is an exploded, isometric view of the sleeve assembly 124, according to one or more embodiments. As illustrated, the sleeve 126 may including a first curved or "arcuate" sleeve section 202*a* and a second curved or "arcuate" sleeve section 202*b*. The first and second arcuate sleeve sections 202*a,b* may comprise half sections (or another fraction) of a tubular length of pipe or tubing, and may be joined together similar to opposing clamshell halves. Each arcuate sleeve section 202*a,b* is configured to transition between a first or "open" state or position, as shown in FIG. 2, and a second or "closed" state or position, as shown in FIGS. 3A and 3B. The radius of each arcuate sleeve section 202*a,b* may be sized to extend over and around the outer circumference of the coiled tubing 104 (FIG. 1). When the first and second arcuate sleeve sections 202*a,b* are transitioned to the closed position, the sleeve 126 will form a generally cylindrical (tubular) and elongate member having an interior diameter (i.e., combined radius of each arcuate sleeve section 202*a,b*) that is the same as or slightly larger than the outer diameter of the coiled tubing 104.

In some embodiments, the first and second arcuate sleeve sections 202*a,b* may comprise independent and non-coupled structures. In such embodiments, the first and second arcuate sleeve sections 202*a,b* would need to be handled separately by the well operator and independently mounted to the coiled tubing 104 during installation. In other embodiments, however, the first and second arcuate sleeve sections 202*a,b* may be pivotably coupled to each other, and thus pivotable between the open and closed states. In such embodiments, the arcuate sleeve sections 202*a,b* may be pivotably coupled using one or more hinges 204 (three shown). Alternatively, or in addition thereto, the arcuate sleeve sections 202*a,b* may be pivotably coupled to each other using a living hinge 206, or the like. In such embodiments, the living hinge 206 may be made of a flexible material, such as a plastic or an elastomer, and may be operatively secured to each arcuate sleeve section 202*a,b* at along all or a portion of a common seam between the two structures.

The sleeve 126 may be made of a variety of rigid materials such as, but not limited to, a metal (e.g., a high-strength, low alloy steel or "HSLAS"), a plastic, a composite material, or any combination thereof. The sleeve 126 exhibits a length L sufficient to extend over (across) the damaged section 122 (FIG. 1) of the coiled tubing 104 (FIG. 1). As an example, the length L of the sleeve 126 may range between about 7 feet and about 10 feet, but could alternatively be shorter than 7 feet or longer than 10 feet, depending on the application (i.e., the size or length of the damaged section 122). In some applications, the length L can be customizable to accommodate varying sizes (lengths) of the damaged section 122. For instance, the length L could be extended by installing two or more sleeves 126 in series.

The sleeve 126, including each arcuate sleeve section 202*a,b*, provides opposing first and second ends 208*a* and 208*b*. In some embodiments, as illustrated, a section of external threading 210 (e.g., pipe threading) may be provided and otherwise defined about the outer circumference of the sleeve 126 (i.e., on each arcuate sleeve section 202*a,b*) at the opposing first and second ends 208*a,b*. As described in more detail below, the external threading 210 may be configured to threadably mate with corresponding internal threading defined on the first and second clamps 128*a,b* to secure the sleeve 126 to the outer circumference of the coiled tubing 104 (FIG. 1).

Figure 4:
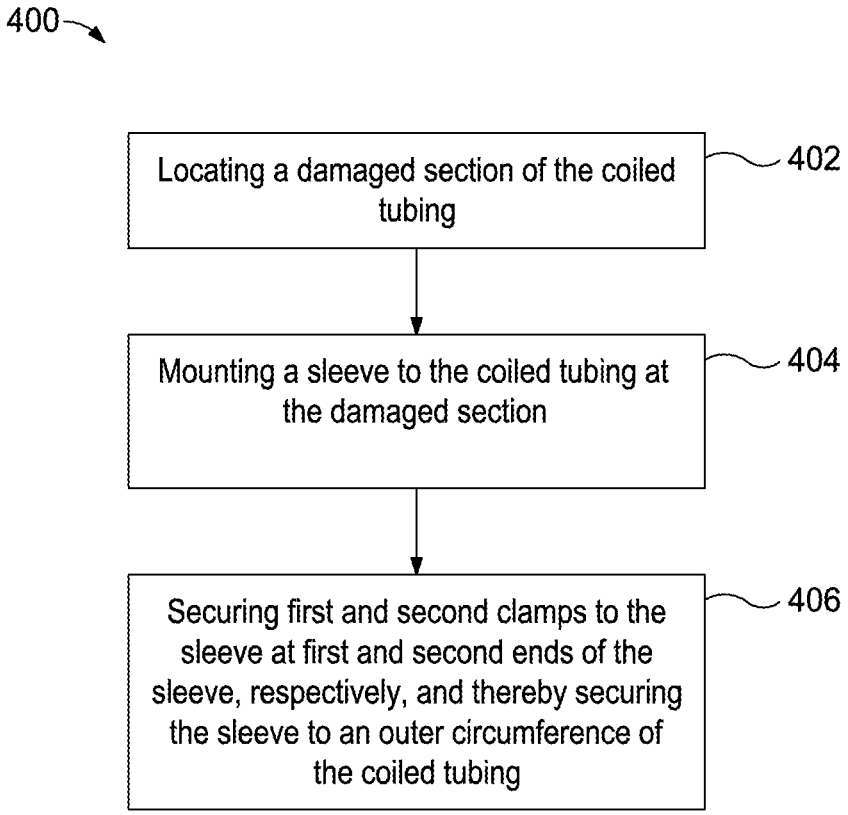
FIG. 4 is a schematic flowchart of an example method of temporarily repairing coiled tubing, according to one or more embodiments.

Similar to the sleeve 126, each clamp 128*a,b* may include first and second arcuate clamp sections 212*a* and 212*b*, where the arcuate clamp sections 212*a,b* may comprise half sections (or another fraction) of a tubular length of pipe or tubing. Moreover, each arcuate clamp section 212*a,b* may be pivotable between a first or "open" state or position, as shown in FIG. 2, and a second or "closed" state or position, as shown in FIGS. 3 and 4. The radius of each arcuate clamp section 212*a,b* may be sized to extend over and around the outer circumference of the coiled tubing 104 (FIG. 1) and the sleeve 126. Accordingly, when the first and second arcuate clamp sections 212*a,b* are pivoted (transitioned) to the closed position, the clamps 128*a,b* will form a generally cylindrical (tubular) member and at least a portion of the clamps 128*a,b* will exhibit an interior diameter (e.g., combined radius of each arcuate clamp section 212*a,b*) the same as or slightly larger than the outer diameter of the sleeve 126.

Similar to the sleeve 126, the first and second arcuate clamp sections 212*a,b* of the clamps 128*a,b* may be pivotably coupled to each other using one or more hinges 204 (two shown), or alternatively using a living hinge 206 extending along all or a portion of a common seam between the arcuate clamp sections 212*a,b*. Furthermore, in some embodiments, the clamps 128*a,b* may be made of the same rigid materials as the sleeve 126. In at least one embodiment, however, the material used for the sleeve 126 may be different than the material used for one or both of the clamps 128*a,b*.

Each clamp 128*a,b*, including each arcuate clamp section 212*a,b*, may provide a section of internal threading 214 (e.g., pipe threading) defined on an inner radial surface of each arcuate clamp section 212*a,b* at a first or "inner" end 216 of the clamp 128*a,b* (e.g., the end adjacent the opposing ends 208*a,b* of the sleeve 126). With the clamps 128*a,b* in the closed position, the internal threading 214 may be configured to engage and threadably mate with the external threading 210 defined on the opposing ends 208*a,b* of the sleeve 126. Rotating the clamps 128*a,b* relative to the sleeve 126 will correspondingly advance the clamps 128*a,b* axially over the opposing ends 208*a,b*, and thereby facilitate a strong grip of the sleeve 126 against the outer circumference (outer surface) of the coiled tubing 104 (FIG. 1).

FIGS. 3A and 3B are side and cross-sectional side views, respectively, of the sleeve assembly 124 installed on a section of the coiled tubing 104, according to one or more embodiments. In particular, the sleeve assembly 124 is installed on the coiled tubing 104 at the location of the damaged section 122 (FIG. 3B) and extends across and otherwise covers the damaged section 122. Referring first to FIG. 3A, the sleeve 126, including the first and second arcuate sleeve sections 202*a,b*, is mounted to and otherwise extends about the outer circumference or surface 302 of the coiled tubing 104. Mounting the sleeve 126 to the coiled tubing 104 may be done manually by a well operator, who locates the damaged section 122 and positions the sleeve 126 on the coiled tubing 104 such that the damaged section 122 is entirely covered by the sleeve 126.

Upon bringing the arcuate sleeve sections 202*a,b* together to the closed position (either pivotably or independently), front and back sleeve seams 304 (only one visible) are formed between the opposing arcuate sleeve sections 202*a,b*. In some embodiments, once moved to the closed position, the arcuate sleeve sections 202*a,b* may be removably coupled to each other using a coupling mechanism 306 arranged at the sleeve seam(s) 304. In embodiments where the arcuate sleeve sections 202*a,b* comprise independent (non-coupled) members, corresponding coupling mechanisms 306 may be provided at each sleeve seam 304 (i.e., front and back). Securing the coupling mechanism(s) 306 may prevent the opposing arcuate sleeve sections 202*a,b* from opening or separating. In other embodiments, however, the coupling mechanism(s) 306 may be omitted and the arcuate sleeve sections 202*a,b* may instead be held together using the clamps 128*a,b*.

The coupling mechanism 306 may comprise any type of device or assembly capable of removably coupling the opposing arcuate sleeve sections 202*a,b*. In the illustrated embodiment, for example, the coupling mechanism 306 comprises a mechanical fastener assembly including opposing brackets 308 secured to each arcuate sleeve section 202*a,b*, and a nut and bolt assembly 310 that can be tightened to secure the brackets 308, and therefore the arcuate sleeve sections 202*a,b*, together.

Once the sleeve 126 is properly positioned on the coiled tubing 104, the clamps 128*a,b* may then be mounted to the coiled tubing 104 at opposing ends 208*a,b* (FIG. 3B) of the sleeve 126. Mounting the clamps 128*a,b* to the coiled tubing 104 may be done manually by pivoting the arcuate clamp sections 212*a,b* toward each other and otherwise to the closed position, thereby forming corresponding clamp seams 312 on each clamp 128*a,b*. In some embodiments, once moved to the closed position, the arcuate clamp sections 212*a,b* of each clamp 128*a,b* may be removably coupled to each other using a coupling mechanism 314. The coupling mechanism 314 may be the same as or similar to the coupling mechanism 306 used to secure the sleeve 126. In other embodiments, however, the coupling mechanism 314 may be entirely or partially different from the coupling mechanism 306.

Once the clamps 128*a,b* are mounted to the coiled tubing 104 and secured together using the coupling mechanisms 314, the clamps 128*a,b* may then be secured to the sleeve 126 at the adjacent ends 208*a,b* (FIG. 3B). In some embodiments, this may be accomplished by manually rotating the clamps 128*a,b* relative to the sleeve 126 (which remains stationary), as shown by the corresponding arrows A. Manually rotating the clamps 128*a,b* relative to the sleeve 126 may thread the clamps 128*a,b* to the sleeve 126 at the opposing ends 208*a,b*. In some embodiments, the clamps 128*a,b* may be rotated simultaneously, but may alternatively be rotated individually.

In FIG. 3B, depicted is the external threading 210 defined on the opposing ends 208*a,b* of the sleeve 126, and the internal threading 214 defined on the inner radial surface of the clamps 128*a,b* adjacent the opposing ends 208*a,b* of the sleeve 126. The clamps 128*a,b* may be secured to the sleeve 126 by threadably mating the external and internal threading 210, 214. As the clamps 128*a,b* are rotated and threadably secured to the sleeve 126, the sleeve 126 may be forced radially inward and into gripping engagement with the outer surface 302 of the coiled tubing 104. In some embodiments, for example, the internal threading 214 of the clamps 128*a,b* may be tapered. In such embodiments, as the clamps 128*a,b* are threaded to the ends 208*a,b* of the sleeve 126, the tapered internal threading 214 drives the opposing ends 208*a,b* radially inward and toward the outer surface 302 of the coiled tubing 104.

In some embodiments, the sleeve assembly 124 may further include one or more seals 316 arranged to provide a sealed interface between the sleeve 126 and the outer surface 302 of the coiled tubing 104. The seals 316 may comprise, for example, elastomeric O-rings, or the like, but could alternatively comprise other types of seals suitable for generating a sealed interface. In the illustrated embodiment, the seals 316 are arranged at or near the opposing ends 208*a,b* of the sleeve 126, but could alternatively be placed at other locations, without departing from the scope of the disclosure.

In some embodiments, the sleeve assembly 124 may be removed from the coiled tubing 104 once the coiled tubing 104 is safely removed from the wellbore, or once the coiled tubing 104 is transported back to a service company warehouse or the like. Accordingly, the sleeve assembly 124 may be used only temporarily and subsequently removed when the coiled tubing 104 is eventually cut and repaired. The sleeve assembly 124 may prove advantageous in adding extra protection to the coiled tubing 104 around the damaged section 122, and sealing around the damaged section 122. The sleeve assembly 124 may secure the damaged section 122 in the reel 102 (FIG. 1) and also during transportation. Moreover, the sleeve assembly 124 may increase the success rate of pulling the coiled tubing 104 out of the wellbore without needing to cut the coiled tubing 104.

FIG. 4 is a schematic flowchart of an example method 400 of temporarily repairing coiled tubing, according to one or more embodiments. As illustrated, the method 400 may include locating a damaged section of the coiled tubing, as at 402. This may entail identifying the damaged section, and rotating a reel about which the coiled tubing is partially wound until the damaged section is located between reel and an adjacent coiled tubing injector assembly. The method 400 may then include mounting a sleeve to the coiled tubing at the damaged section, as at 404. The sleeve may have opposing first and second ends and may exhibit a length sufficient to extend over and cover the damaged section. The method 400 may then include securing first and second clamps to the sleeve at the first and second ends, respectively, and thereby securing the sleeve to an outer circumference of the coiled tubing, as at 406.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A coiled tubing system, comprising:
a coiled tubing injector assembly;
a reel arranged adjacent the injector assembly;
coiled tubing extending between the reel and the injector assembly and partially wound onto the reel, the coiled tubing having damaged section; and
a sleeve assembly removably attachable to the coiled tubing at the damaged section, the sleeve assembly including:
a sleeve having opposing first and second ends and sized to be received about an outer circumference of the coiled tubing, the sleeve exhibiting a length sufficient to extend over and cover the damaged section; and
first and second clamps removably attachable to the sleeve at the opposing first and second ends, respectively, and thereby securing the sleeve to the outer circumference of the coiled tubing.

2. The system of claim 1, wherein the sleeve provides external threading defined on each of the first and second ends, and each clamp defines internal threading configured to threadably mate with the external threading to secure the sleeve to the coiled tubing.

3. The system of claim 1, wherein the sleeve comprises first and second arcuate sleeve sections that jointly exhibit an interior diameter the same as or slightly larger than an outer diameter of the coiled tubing, and wherein each clamp comprises first and second arcuate clamp sections that jointly exhibit an interior diameter the same as or slightly larger than an outer diameter of the sleeve.

4. The system of claim 3, wherein the first and second arcuate sleeve sections comprise independent and non-coupled structures.

5. The system of claim 3, wherein the first and second arcuate sleeve sections are pivotably coupled to each other.

6. The system of claim 3, wherein the first and second arcuate clamp sections are pivotably coupled to each other.

7. The system of claim 3, wherein the first and second arcuate sleeve sections are removably coupled to each other using a coupling mechanism arranged at a sleeve seam defined between the first and second arcuate sleeve sections.

8. The system of claim 3, wherein the first and second arcuate clamp sections are removably coupled to each other using a coupling mechanism arranged at a clamp seam defined between the first and second arcuate clamp sections.

9. The system of claim 1, further comprising one or more seals arranged to provide a sealed interface between the sleeve and the outer circumference of the coiled tubing.

10. A method of repairing coiled tubing, comprising:
locating a damaged section of the coiled tubing;
mounting a sleeve to the coiled tubing at the damaged section, the sleeve having opposing first and second ends and exhibiting a length sufficient to extend over and cover the damaged section; and
securing first and second clamps to the sleeve at the first and second ends, respectively, and thereby securing the sleeve to an outer circumference of the coiled tubing.

11. The method of claim 10, wherein the sleeve comprises first and second arcuate sleeve sections and each clamp comprises first and second arcuate clamp sections, the method further comprising:
mounting the first and second arcuate sleeve sections to the outer circumference of the coiled tubing at the damaged section;
coupling the first and second arcuate clamp sections of the first clamp and then securing the first clamp to the first end of the sleeve; and
coupling the first and second arcuate clamp sections of the second clamp, and then securing the second clamp to the second end of the sleeve.

12. The method of claim 11, wherein the first and second arcuate clamp sections of each clamp are pivotably coupled to each other, and wherein coupling the first and second arcuate clamp sections of each clamp comprises:
pivoting the first and second arcuate clamp sections to a closed position and thereby defining a clamp seam; and
securing the first and second arcuate clamp sections together at the clamp seam using a coupling mechanism.

13. The method of claim 10, wherein the sleeve provides external threading defined on the first and second ends, and each clamp defines internal threading, and wherein securing the first and second clamps to the sleeve at the first and second ends comprises threading the first and second clamps to the sleeve at the first and second ends, respectively.

14. The method of claim 13, wherein the internal threading is tapered, the method further comprising forcing the first and second ends radially inward and into gripping engagement with the outer circumference of the coiled tubing as the first and second clamps are threaded onto the first and second ends, respectively.

15. The method of claim 10, wherein one or more seals are arranged between the sleeve and the outer circumference of the coiled tubing, and wherein securing the first and second clamps to the sleeve at the first and second ends comprises generating a sealed interface between the sleeve and the outer circumference of the coiled tubing with the one or more seals.

16. The method of claim 10, wherein the coiled tubing is partially wound onto a reel arranged adjacent a coiled tubing injector assembly, and the coiled tubing extends between the reel and the injector assembly, and wherein locating the damaged section of the coiled tubing comprises:

locating the damaged section between the reel and the injector assembly; and mounting the sleeve to the coiled tubing and securing first and second clamps to the sleeve at the first and second ends, respectively, while the damaged section is located between the reel and the injector assembly.

* * * * *